US007156882B2

(12) United States Patent
Gomez

(10) Patent No.: US 7,156,882 B2
(45) Date of Patent: Jan. 2, 2007

(54) METHOD FOR BLEACHING TEXTILE FIBERS

(76) Inventor: Fermin Enecoiz Gomez, Florencia 57, 5 Piso, Col. Juarez, Delegacion Cuahutemoc (MX)

( * ) Notice: Subject to any disclaimer, the term of this patent is extended or adjusted under 35 U.S.C. 154(b) by 177 days.

(21) Appl. No.: 10/796,334

(22) Filed: Mar. 8, 2004

(65) Prior Publication Data

US 2005/0075263 A1 Apr. 7, 2005

(30) Foreign Application Priority Data

Oct. 3, 2003 (MX) ..... PA/a/2003/009081

(51) Int. Cl.
*D06L 3/06* (2006.01)

(52) U.S. Cl. ..... 8/108.1; 8/137

(58) Field of Classification Search ..... 510/380, 510/370, 436; 252/187.26; 8/115.7, 115.69, 8/108.1, 137
See application file for complete search history.

(56) References Cited

U.S. PATENT DOCUMENTS 5,775,121 A * 7/1998 Kuma et al. ..... 62/314
5,780,412 A * 7/1998 Scarborough et al. ..... 510/240
5,948,268 A * 9/1999 Yamaguchi et al. ..... 210/701
6,055,824 A * 5/2000 Kuma et al. ..... 62/314
2003/0109404 A1* 6/2003 Todini ..... 510/367

FOREIGN PATENT DOCUMENTS

WO WO 99/15615 * 4/1999

OTHER PUBLICATIONS

ChemicalLand21.com product description webpage, Nov. 10, 2000, http://web.archive.org/web/20060117155502/http://www.chemical-land21.com/industrialchem/inorganic/DISODIUM%20PHOSPHATE%20(12HYDRATE).htm.*

* cited by examiner

*Primary Examiner*—Lorna M. Douyon
*Assistant Examiner*—Jaison Thomas
(74) *Attorney, Agent, or Firm*—Ostrolenk, Faber, Gerb & Soffen, LLP

(57) ABSTRACT

Processes for cleaning and bleaching using bleaching solutions comprising water disodium phosphate dodecahydrate and/or phosphoric acid at 75% of food grade. The solutions can be used for both household and industrial purposes.

6 Claims, No Drawings

METHOD FOR BLEACHING TEXTILE FIBERS

FIELD OF THE INVENTION

The present invention refers to cleaning and bleaching procedures, by using bleaching solutions containing sodium hypochlorite, water, disodium phosphate dodecahydrate and/or diphosphonic-1,1-hydroxyethane-1 acid and/or phosphoric acid at 75% of food grade, said solutions can be used for both, household and industrial purposes.

Bleaching compositions are well known in the state of the art, being preferred those that use sodium hypochlorite for fabrics, bleaching and for disinfecting or cleaning purposes.

According to specifications of the official standard in our country, sodium hypochlorite is considered as a dangerous material, when containing more than 5% of active chlorine, according to NOM-002 standard of 1994, published by the official gazette of Oct. 30, 1995 and which is indicated that for its handling, special means of transportation shall be used as well as the use of a protecting material for its handling.

BACKGROUND OF THE INVENTION

A bleaching procedure is generally understood as the chemical destruction of chromophores in organic or inorganic compounds; where the purpose of bleaching is to increase a weak brightening or to improve the color of the material that is bleached At the industrial level, bleaching is often combined with cleaning agents. Scrubbing or rubbing a fabric through pre-bleaching means treating a fabric or a fiber with an alkali, pumice stone and enzymes at 65° C. Scrubbing main functions are to dissolve stains or particles to emulsify waxes and oils formed by the absorbents of the fabric to bleach. After scrubbing the fabric is ready to be bleach with sodium hypochlorite.

Historically, the sodium hypochlorite was first used in the fabrics industry to bleach linen. When the use of cotton was introduced, this fiber was also bleached with the hypochlorite. The treatment with hypochlorite is followed by a treatment of the anti-chlorine (sodium bisulphite, sulphur dioxide, or hydrogen peroxide) to avoid the color fading (cloramides formation). However, the hypochlorite solutions previously used for bleaching fabrics, cause the undesirable corrosion of the equipment. Furthermore, hypochlorite solutions products have low concentrations of HOCL and contain impurities that substantially reduce their stability. During the bleaching procedure, followed by the sizing material removal, the fabric is immersed in a sodium hypochlorite solution heated during a period of time long enough to remove stains or particles.

Then, the scrubbed fabric, is treated with the bleaching solutions, containing several additives such as silicates, at higher temperatures during long periods of time in order to bleach fabrics.

Bleaching compositions are used for a variety of several purposes, being particularly interesting herein, the fabrics bleaching with a solution containing sodium hypochlorite and a further bleacher comprising sodium hypochlorite, water, phosphates and phosphoric acid.

Frequently, fabrics bleaching procedure presents the inconvenience of yellowing the fabric, and this is due to the hypochlorite used for the bleaching procedure.

It has been found that this defect is directly related to, when the hypochlorite solutions used for bleaching the fabrics additionally comprise an effective amount of silicate metal alkaline salts, such as Cu, Fe, Ni, and Co. It is widely known that the presence of silicates within the solution plays the role of moderating or preventing the attack of the hypochlorite upon the brightening agents that are deposited upon the surface of the fabrics or clothes during their elaboration.

This is, in the absence of silicates, the hypochlorite attack occurs upon the brightening agents deposited over the fabrics surface, which causes the yellowing phenomenon.

In this field, bleaching compositions are known, and particularly bleaching compositions comprising phosphates and additionally said compositions also comprise pH buffering components, obtaining chemically stable compositions. By chemically stable compositions it is understood that the hypochlorite bleaching composition does not suffer any loss higher than the 15% of chlorine available after five days of storage at 50° C.±5° C.

SUMMARY OF THE INVENTION

Surprisingly and effectively, the object of the present invention has solved the chlorine stability loss existing in the market; by using an adequate bleaching solution to be added to the hypochlorite charges used on the industrial bleaching products or bleaching products for household purposes.

Consequently, the object of the present invention is to improve the whiteness that any bleaching agent existing in the market could offer; in addition to the bleaching procedures, solutions or charges containing sodium hypochlorite; wherein they comprise the addition of a solution comprising the following components at the following ratios:

Household Use

97% water, plus 2% of disodium phosphate dodecahydrate, plus 1% of phosphoric acid at 75% of food grade; 96.7% water, plus 1% of diphosphonic-1,1-hydroxyethane acid and 2.3% of phosphoric acid at 75% of food grade; 96.5% of water and 3.5% of phosphoric acid at 75% of food grade.

Industrial Use 93.5% of water, plus 2% of diphosphonic-1,1-hydroxyethane-1 acid; and 4.5% of phosphoric acid at the 75% of food grade 93% of water and 7% of phosphoric acid at 75% of food grade.

DETAILED DESCRIPTION OF THE INVENTION

The present invention refers to bleaching procedures using sodium hypochlorite and to bleaching solutions for household use. By establishing the addition to the charge of sodium hypochlorite to be used of any existing concentration in the market, and to commercially known bleaching agents for household use of said bleaching solutions comprising the following formulations.

Formulations for household use:

a) 97% water, plus 2% of disodium phosphate dodecahydrate, plus 1% of phosphoric acid at 75% of food grade;

b) 96.7% water, plus 1% of diphosphoric-1,1-hydroxiethane-1 acid, plus 2.3% of phosphoric acid at 75% of food grade;

c) 96/5% water, plus 3/5% of phosphoric acid at 75% of food grade;

Formulations for Industrial Use d) 93.5% water, plus 2% of diphosphoric-1,1-hydroxiethane-1 acid, plus 4.5% of phosphoric acid at 75% of food grade;

e) 93% water, plus 7% of phosphoric acid at 75% of food grade;

Bleachers Preparation

Materials for Preparing a Cloralex or Clorox-Type Bleacher for Household Use

In this case, the applicant used sodium hypochlorite at any concentration;

Treated water;

Formulations a) to c) of bleach for household use.

Preparation of a Bleacher with 3 G/LT of Free Chlorine for Household Use

A bleaching solution is prepared with the following ratios:

75% of water;

1% of formulations a), b) or c) for a bleacher for household use;

24% of sodium hypochlorite with 13 g/lt of free chlorine;

Base formula used for tests made
SODIUM HYPOCHLORITE 13 G/LT OF FREE CHLORINE

| PARAMETERS | UNITS g/L | RESULTS |
|---|---|---|
| ESTIMATED CHLORINE | g/L | 13.20 |
| SODIUM HYDROXIDE | g/L | 3.15 |
| SODIUM CARBONATE | g/L | 1.98 |
| DENSITY | g/L | 1.202 |
| IRON | p.p.m | 0.52 |
| TRANSMITTANCE | % | 99 |
| PH | | 14 |

FORMULA USED TO PREPARE A BLEACHER WITH 13 G/LT OF FREE CHLORINE FOR HOUSEHOLD USE

| PARAMETERS | UNITS G/L | RESULTS A, b, or c |
|---|---|---|
| ESTIMATED CHLORINE | G/L | 3.0 |
| SODIUM HYDROXIDE | G/L | 0.00 |
| SODIUM CARBONATE | G/L | 0.58 |
| DENSITY | G/L | 1.038 |
| IRON | p.p.m | 0.10 |
| TRANSMITTANCE | % | 99 |
| PH | | 11 |

Method:
75% water; 24% of sodium hypochlorite, formula 13 g/l and 1% of prepared formulation a, b or c.

Development

It is important to notice that a 1% of the formulation a, b or c is being indicated to prepare a bleacher for household use and that the amount of this formulation to be applied should be the necessary for carrying this solution to a pH of 11, tests made confirm that the stability of chlorine is balanced at a pH of 11; and that over a pH of 12 or 14, the bleaching solution prepared losses its active power.

In this case, the breaking up of chlorine occurs slowly, while at a lower level this is, at a pH of 10 or less, that chlorine breaking up occurs faster.

According to the above mentioned, the importance of this event resides in keeping the pH at 11 of the bleacher, achieving a reduction of the 50% of the amount of sodium hypochlorite applied, which is commonly used in the market; resulting in a bleacher with properties totally improved.

On the other hand, the amount of the bleaching solution prepared a, b and c, to be added shall also depend on the sodium hydroxide amount that the hypochlorite contains.

In order to prove the above, witnessing tests were run, taking products commonly known in the market such as CLOROX and CLORALEX while they are leader products in the national level and in the United States, obtaining excellent results which are confirm through the following test:

Tests Made to Determine the Existing Differences Between Clorox and Cloralex Products, Against the Improved Bleacher Claimed Herein.

Procedure

1.—1 liter of bleach CLOROX, 5 g/lt of free chlorine and CLORALEX 6 g/lt of free chlorine were used separately;

2.—To each solution, 1 liter of demineralized water was used to reduce the free chlorine content at 50%;

3.—1% of the formula a, b or c, was added for the household bleach to each solution;

4.—with the same formula, each solution was adjusted to a pH of 11;

5.—each solution is stabilized at the 50% from the manufacturer's original concentration, without any changes.

Following, tests made are described when adding the formulation for household use a, b and c; which confirm and prove that only with the 50% of the original product (hypochlorite); plus 1% of the formulation, it is possible to totally improve at the 100% from the original product.

Tests Carried Out

Stability Tests Using Solutions a, b and c

Tests were made, with clear containers stored during a period of one year, in a lighted warehouse at an average temperature of 20° C. Ending this period of time, the stored solution was analyzed and only a loss of 0.4 g/lt of free chlorine of the solution was determined, practically keeping the active power of the mixture intact.

The above proves that any of the formulations a, b and c of the present invention stabilizes the bleaching formulation enlarging its period of life, revolutionizing with this fact the bleaching active power of any existing sodium hypochlorite, using a combination of bleaching solutions for household and industrial use, according to the procedure and formulations indicated hereby.

Resulting benefits of using the formulations a, b and c of the present invention, when adding to the hypochlorite charges the conventional bleaching procedures obtained are the following:

Our formulations stabilize the solution enlarging its period of life since it has been tested within clear containers stored within a lighted warehouse at an average temperature of 20° C., during a period of one year, that the solutions only loss 0.4 g/lt wherein the bleaching power remains intact, so the applicant revolutionizes with this formulation the way of being of any sodium hypochlorite existing in the market.

Our formulas can reach bleaching in a lesser time compared to the formulations conventionally used, since the above reduce the time from 10 to 25% compared to any other solution.

Bleaching solutions of the present invention achieve a perfect bleaching, without leaving the yellowish color of the normal sodium hypochlorite.

When applying the formulations a, b and c, the amount of sodium hydroxide and silicates in the solution with a pH 11 is reduced. Reducing alkalinity of the solution and by improving it, since this solution does not cause any irritation of the eyes, nor cause any harmful injury on the skin or nails when being used at home.

Furthermore, clothes period of life is extended since it is not harmed not attacked by a hypochlorite with 100% more of the free chlorine concentration and a high content of sodium hydroxide and silicates.

With the above, benefits are redundant upon the environment and ecology since resulting wastes do not contain any dangerous chemical residues.

A bleaching solution or bleacher prepared with our formulation a, b or c, does not result in a toxic product for human consumption since the solutions do not use products in the proportions that could result harmful for human health.

The solutions of the present invention reduce serious accidents at home and the latent danger of having a solution with a lesser concentration of chlorine since it results less aggressive, having only the 50% of its corrosive power.

The solutions proposed herein clean stains better and quicker than a bleaching solution with a conventional sodium hypochlorite, besides, due to its disinfecting active power, they could be used for disinfecting water and surfaces that require to be clean; in the same way that any cleaning solution with commercially known sodium hypochlorite.

These results show that in the market there is not any similar product with this low concentration of free chlorine at a pH of 11. The formulations a, b and c for household bleachers work the same as any sodium hypochlorite provided by any manufacturer, and that in the production of bleachers, a 50% less of sodium hypochlorite will be used adding the solution a, b and c, besides that excellent results will be obtained with a pH of 11.

Chlorine Testing was Carried Out Through the Following Iodometric Method

Procedure

A clean capillary tub is inserted within a cartridge of titering solution (titrant) of thiosulphate (2.26 N). Said cartridge is placed on the body of a titering agent (titrant).

Then, the capillary tub is filled and some drops of the titering solution (titrant) are spilled out. Afterwards, the counter is set a zero and the tip of the tub is dry. Separately, the Erlenmeyer flask is filled up to the scale of 75 ml with deionized water or tap water.

Note: the concentration of residual chlorine that the tap water contains does not affect this test.

Add the content of potassium iodide powder caplet to the flask and shake the flask until mixing.

Besides, add the content of a caplet of a powdered acid reacting agent to the flask and shake the flask until mixing.

Place a clean tip on the 100 μl dispenser. Note: instead, a TenSette® pipet with a clean tip can be used.

Use the dispenser to add to volumes (200) μl of a sample of bleach under the level of the solution in the flask.

Shake well until mixing. The solution will turn of a dark brownish-gray color.

Place the end of the capillary tub within the solution and shake the flask while it is titered with the thiosulphate, until the solution turns to a pale yellow color.

Add a drip filled with the starch-tracer solution to the flask and shake until mixing. A dark blue or green color will appear.

Continue with titering (titrating) until the solution turns colorless. Record the numeric value that appears on the counter.

Calculations:

G/L of chlorine=digits required *0.5

Note: divide by ten the g/l of chlorine to obtain the % (per volume) of chlorine.

Method for the Bleaching Test

Equipment

1.—Bleach A

2.—Bleach B (solution to be compared).

3.—Precipitation flasks of 500 ml.

4.—Stirring rods

5.—Clothes of mixed fibers (pieces)

6.—Chronometer

7.—Sodium bisulphite

8.—4 lt container

Method

1.—Two precipitation flasks are taken; in one flask 200 ml of the bleach A are placed; in the second flask 200 ml of the bleach B are placed; each solution is perfectly stirred separately, the temperatures of both solutions that should be the same, between 20 and 24° C. are taken.

2.—A piece of clothes of mixing fibers is introduced in each solution at the same time and the chronometer to count the time is set up; with the aid of the stirring rods, the piece of clothe is kept on the bottom portion of the flask so the solution can cover it perfectly.

3.—Each solution is left during a period approximately of 10 minutes or the time required according to the color of the clothe that is desired to be obtained; latter on, the pieces of clothe are removed from each of their corresponding solution and are immediately introduced each one in a solution to neutralize chlorine (3 lt of water plus 30 gr of sodium bisulphite); they are perfectly rinsed and placed within another water solution only as a second rinse to eliminate any residue.

4.—Both samples are dried and ironed in order to observe accurately the washing off on each piece of clothe of mixed fibers, having as a result a piece of clothe of mixed fibers getting more bleached, where the solution acted better and faster and in order to prove it, the differences in shade are compared.

Results

To determine the difference in time (minutes) and to convert it into a percentage between both solutions, the following steps are carried out:

Two chronometers are taken and time is recorded, in which the first piece of clothe that was washed off faster in a medium shade was removed from the solution.

It is neutralized and it is expected that the slower solution washes off the second piece of clothe of mixed fibers at the same shade the first clothe took, when the same tonality is reached, the reaction is stopped by neutralizing with carbonate, and the difference in time is taken as well as the percentage of the faster solution is obtained and then, the bleaching shade is analyzed.

The experimental development of the formulations d and e application for industrial use is described as follows.

Formulation for a Bleaching Solution of Bleacher Chlorine for Industrial Use

The solutions d and e will be used as additives to be utilized at the industrial level fro textile plants for bleaching fabrics and yams, for industrial laundries for clothes bleaching, and mainly for clothes formed from mixed fibers (known as denim) bleaching or fading.

Application of the Bleaching Solutions D and E for Textile Bleaching and Industrial Laundry Procedures At an industrial level, the use of the formulation d or e reduces significantly economic costs, since only the 50% of sodium hypochlorite is applied, same that is used for conventional bleaching, plus a 10% of the amount of solution d or e.

Method to Bleach Different Industrial Fibers

In the normal procedures for washing or bleaching or fading on each industry, mainly bleaching denim clothes at the moment of reducing the clothe of mixed fibers color shade, only the 50% of sodium hypochlorite that is normally used for the same purpose is added to the amount of water and the 10% of the bleaching solution d or e is added until carrying this solution to a pH 7.

The determining point on this step of the procedure lies on that the same solutions stabilizes chlorine and it is not necessary to neutralize it since it works at a pH 7. It is important to mention that in any step of the bleaching procedure, the addition of chlorine stabilizers is necessary nor chlorine with sodium bisulphite or similar products have to be neutralized at the end of the procedure.

Obtaining with the above a reduction of the 50% of the sodium hypochlorite, plus cost savings on chemicals that are eliminated, since the neutralization of the solution with sodium bisulphite or any chlorine neutralizer is not necessary, thus avoiding the exothermic reaction and sometimes explosive reactions when are added to chlorine, which also prevents physical injury to the personnel in charge of the procedure, prevents damages to the flora and fauna caused by wastes as well as avoids pollution to phreatic stratum caused when this kind of waters are disposed.

Following said procedure totally improved, allows textile industry to recycle residual waters to a lower cost.

Therefore, both the procedure and solutions d and e suggested herein, result in a great technical improvement for the textile industry.

Method for the Bleaching Test

Equipment

1.—BLEACH A

2.—BLEACH B (SOLUTION TO BE COMPARED)

3.—PRECIPITATION FLASKS OF 500 ML

4.—STIRRING RODS

5.—PIECES OF DENIM CLOTHES

6.—CHRONOMETER

7.—SODIUM BISUHPHITE

Method

1.—Two precipitation flasks are taken; in one flask 200 ml of the bleach A are placed; in the second flask 200 ml of the bleach B are placed; each solution is perfectly stirred separately, the temperatures of both solutions that should be the same, between 20 and 24° C. are taken.

2.—A piece of denim clothing is introduced in each solution at the same time and the chronometer to count the time is set up; with the aid of the stirring rods, the piece of clothe is kept on the bottom portion of the flask so the solution can cover it perfectly.

3.—Each solution is left during a period approximately of 10 minutes or the time required according to the color of the clothe that is desired to be obtained; latter on, the pieces of clothe are removed from each of their corresponding solution and are immediately introduced each one in a solution to neutralize chlorine (3 lt of water plus 30 gr of sodium bisulphite); they are perfectly rinsed and placed within another water solution only as a second rinse to eliminate any residue.

4.—Both samples are dried and ironed in order to observe accurately the washing off on each piece of denim clothe, having as a result a piece of denim clothe getting more bleached, where the solution acted better and faster and in order to prove it, the differences in shade are compared.

Results

To determine the difference in time (minutes) and to convert it into a percentage between both solutions, the following steps are carried out:

Two chronometers are taken and time is recorded, in which the first piece of clothe that was washed off faster in a medium shade was removed from the solution.

It is neutralized and it is expected that the slower solution washes off the second piece of denim clothe at the same shade the first clothe took, when the same tonality is reached, the reaction is stopped by neutralizing with carbonate, and the difference in time is taken as well as the percentage of the faster solution is obtained and then, the bleaching shade is analyzed.

Following, a comparative table is shown in which it is referred for the quality certificate of commercial sodium hypochlorite and the quality certificate of the sodium hypochlorite of the formulations d and e of the present invention, in which the amount of chlorine titered of the solutions of the present invention is determined Base formula used for tests carried out with SODIUM HYPOCHLORITE 13 G/LT OF FREE CHLORINE

| PARAMETERS | UNITS g/L | RESULTS |
|---|---|---|
| ESTIMATED CHLORINE | g/L | 13.20 |
| SODIUM HYDROXIDE | g/L | 3.150 |
| SODIUM CARBONATE | g/L | 1.98 |
| DENSITY | g/L | 1.202 |
| IRON | p.p.m | 0.52 |
| TRANSMITTANCE | % | 99 |
| PH | | 14 |

Formula used when adding bleach d or e. In a 10% to the base formula of sodium hypochlorite up to pH 7*

| PARAMETERS | UNITS G/L | RESULTS d or e |
|---|---|---|
| ESTIMATED CHLORINE | G/L | 13.20 |
| SODIUM HYDROXIDE | G/L | 0.00 |
| SODIUM CARBONATE | G/L | 0.00 |
| DENSITY | G/L | 1.20 |
| IRON | p.p.m | 0.52 |
| TRANSMITTANCE | % | 99 |
| PH | | 7 |

Method

Water on free supply according to the bleaching procedure used; sodium hypochlorite in an amount equivalent to the 50% of the common amount on said procedure; 10% of the solutions d or e; or the amount of solution necessary to carry thereof to a pH 7.

Conclusions

According to the above described, it is shown that a bleacher for household or industrial use is totally improved when solutions a, b, c, d or e suggested herein are added. As stated before, exceeding the sanitary or health official standards established in our country and being closer to standards established by countries with more stringent standards, such as Brazil, it is important to note that due to Mexican laws provisions, it is only allowed to sell bleaching solutions or bleachers with a maximum of 5 g/lt of free chlorine, while our formulations are handled at a level of 3 g/lt of free chlorine.

According to the foregoing, it is absolutely certain that the solution suggested herein better and faster removes the stains than a conventional sodium hypochlorite, besides having an important cost savings when being used by manufacturers in the preparation of bleachers and in the use of these bleaching solutions in industrial bleaching procedures, contributing also to have greater benefits for the ecology and environment.

The invention claimed is:

1. A method for bleaching textile fibers with a chlorine bleaching solution, which method comprises the following:

(a) preparing a first solution containing bleaching chlorine, said solution comprising either 2.5 g/L or 3.0 g/L of free chlorine (b) adding to said first solution 1% of a second, separate solution to form a third solution, said second solution selected from the group consisting of (i) 97% water, 2% disodium phosphate dodecahydrate and 1% phosphoric acid at 75% of food grade; (ii) 96.7% water, 1% diphosphonic-1-1-hydroxyethane-1 acid and 2.3% phosphoric acid at 75% of food grade; and (iii) 96.5% water and 3.5% phosphoric acid at 75% of food grade;

(c) adjusting and stabilizing said third solution to a pH of 11; and (d) bleaching said fibers in the stabilized solution.

2. The method for bleaching, according to claim 1, wherein the textile fibers can be clothes.

3. A method for bleaching textile fibers with a household chlorine bleaching composition, which method comprises the following steps:

(a) preparing a solution containing 1 L of bleaching chlorine having 5 g/L of free chlorine;

(b) adding to said solution, 1 L of demineralized water to reduce a concentration of free chlorine contained therein to 50%;

(c) adding to said solution 1% of a separate solution selected from the group consisting of (i) 97% water, 2% disodium phosphate dodecahydrate and 1% phosphoric acid at 75% of food grade; (ii) 96.7% water, 1% diphosphonic-1-1-hydroxyethane-1 acid and 2.3% phosphoric acid at 75% of food grade; and (iii) 96.5% water and 3.5% phosphoric acid at 75% of food grade;

(d) adjusting said solution containing 1% of said separate solution selected from the group consisting of (i), (ii) and (iii) to a pH of 11;

(e) stabilizing said solution at 50% of their original concentration; and (f) bleaching said fibers in the stabilized solution.

4. The method for bleaching, according to claim 3, wherein the textile fiber can be clothes.

5. A method for bleaching textile fibers with a household chlorine bleaching composition, which method comprises the following steps:

(a) preparing a solution containing 1 L of bleaching chlorine having 6 g/L of free chlorine;

(b) adding to said solution, 1 L of demineralized water to reduce a concentration of free chlorine contained therein to 50%;

(c) adding to said solution 1% of a separate solution selected from the group consisting of (i) 97% water, 2% disodium phosphate dodecahydrate and 1% phosphoric acid at 75% of food grade; (ii) 96.7% water, 1% diphosphonic-1-1-hydroxyethane-1 acid and 2.3% phosphoric acid at 75% of food grade; and (iii) 96.5% water and 3.5% phosphoric acid at 75% of food grade;

(d) adjusting said solution containing 1% of said separate solution selected from the group consisting of (i), (ii) and (iii) to a pH of 11;

(e) stabilizing said solution at 50% of their original concentration; and (f) bleaching said fibers in the stabilized solution.

6. The method for bleaching, according to claim 5, wherein the textile fiber can be clothes.

* * * * *